US010386148B1

(12) United States Patent
Handrick

(10) Patent No.: US 10,386,148 B1
(45) Date of Patent: Aug. 20, 2019

(54) HEAT DISPLACEMENT TOOL AND METHOD OF DISPLACING HEAT

(71) Applicant: Alexander S Handrick, Dayton, OH (US)

(72) Inventor: Alexander S Handrick, Dayton, OH (US)

( * ) Notice: Subject to any disclaimer, the term of this patent is extended or adjusted under 35 U.S.C. 154(b) by 0 days.

(21) Appl. No.: 15/914,781

(22) Filed: Mar. 7, 2018

(51) Int. Cl.
*F41A 21/44* (2006.01)
*F41A 13/12* (2006.01)
*F41A 21/24* (2006.01)

(52) U.S. Cl.
CPC ..... *F41A 21/44* (2013.01); *F41A 13/12* (2013.01); *F41A 21/24* (2013.01)

(58) Field of Classification Search
CPC ..... F41A 21/44; F41A 21/22; F41A 21/24; F41A 13/12; F41C 23/16
USPC ..... 89/14.1; 42/76.02
See application file for complete search history.

(56) References Cited

U.S. PATENT DOCUMENTS 3,999,461 A * 12/1976 Johnson ..... F41A 5/22 89/191.01
4,663,875 A * 5/1987 Tatro ..... F41C 23/16 165/134.1
4,753,154 A * 6/1988 Higashi ..... F41A 21/44 165/104.26
5,010,676 A * 4/1991 Kennedy ..... F41C 23/16 42/71.01
5,201,135 A 4/1993 Cowles
5,343,650 A * 9/1994 Swan ..... F41C 23/16 42/117
7,802,392 B2 * 9/2010 Peterson ..... F41A 11/02 42/124
9,207,031 B2 * 12/2015 Balthaser ..... F41A 21/44
9,995,557 B2 * 6/2018 Geissele ..... F41C 23/02
2013/0276342 A1 * 10/2013 Chvala ..... F41A 13/12 42/90
2014/0082990 A1 * 3/2014 Lee ..... F41A 21/24 42/96
2016/0153734 A1 * 6/2016 Oliver ..... F41A 13/12 89/14.1
2017/0138692 A1 * 5/2017 Tubb ..... F41A 21/44
2017/0299291 A1 * 10/2017 Spector ..... F41G 11/003
2018/0292159 A1 * 10/2018 Thompson ..... F41A 21/24

* cited by examiner

*Primary Examiner* — John Cooper
(74) *Attorney, Agent, or Firm* — Brandon Carlin

(57) ABSTRACT

A heat displacement tool firearm accessory, and a method for mounting such a firearm accessory to a firearm, the heat displacement tool providing a frame, including a base for mounting along a firearm mounting rail, the frame defining a generally hollow core adapted to receive and dissipate firearm barrel heat. The heat displacement tool is at least half the length of the firearm barrel and is capable of being mounted in a location between a firearm barrel and an optic or rear sight, so as to reduce or eliminate barrel mirage.

19 Claims, 8 Drawing Sheets

20
122
120
124
126
48
48
48

HEAT DISPLACEMENT TOOL AND METHOD OF DISPLACING HEAT

FIELD

The present invention is directed to the field of firearms, more particularly to the mounting of accessories on a firearm and methods for configuring a rifle with an accessory specifically for the displacement, and/or removal of heat associated therewith.

INTRODUCTION

Firearms have been in use for hundreds of years. Early renditions of the firearm were little more than hand-held artillery pieces, and suffered from slow reloading time and severe inaccuracy. In some early renditions of firearms known as muskets, the user lit a fuse with a small torch or match which ignited the gunpowder inside and propelled the round, which was commonly a lead ball. This lead ball would be forcefully projected in a general direction away from the firearm. The effective range of this type of firearm was around 75 yards. Commonly, a user would aim at a target spaced at a great distance and miss their target by ten feet or more.

Due to the inaccuracy of the musket, generals would have these firearm users, sometimes referred to as musketeers, stand extremely close and fire en masse so as to create a wave of projectiles at their target(s).

Rifled muskets came in vogue in the mid-nineteenth century, and were commonly used during the United States Civil War. The rifling of the musket barrel provided longer range ability of the musket to approximately 200 yards with an increase in accuracy as well. As the United States Civil War progressed, newer advancements of firearms led to some specialized rifles allowing a firearm user to load their ammunition into the chamber of the rifle, instead of down the barrel of the rifle.

Near the turn of the century, muskets had become obsolete, as rifles had become the firearm of choice for its increased penetration power, rate of fire, and accuracy. The stalemate on the western front in the First World War led to numerous technological innovations, such as tanks and machine guns. However, one other invention was the creation of the telescopic sight for a rifle.

The telescopic sight allowed a user to see clearly at a farther distance than they previously could have done with just their naked eye. Since previous renditions of firearms were not accurate at extreme ranges, the ability to see clearly a target one could not effective hit with their rifle was non-essential. By World War 2 in the 1940s, these specialty rifle users, sometimes referred to as snipers, were hitting targets at 600-800 yards. In the modern days, some snipers have hit targets at astonishing distances greater than 2000 yards.

However, many problems arise for a user of a modern-day rifle when they are trying to hit a target at such a long range distance, colloquially thought of as a distance to target of over 800 yards. A long-range shooter must calculate a variety of external factors in order to precisely calculate the trajectory of their bullet, which is the projectile fired from the barrel of the rifle. Some of the calculations required by the long-range shooter are: the distance from the target, the elevation difference between the rifle and the target, the temperature, the muzzle velocity, the wind direction, the wind speed, the barometric pressure, the relative humidity, the shape of the bullet, the weight of the bullet, the Coriolis Effect, and mirage.

Mirage is an optical illusion created by a difference in temperatures between locations of sight. Photons, which are particles of light, travel in a generally straight line when temperature is generally consistent between two points. When there is a difference in temperature between two points, these photons are refracted, or bent. Cold air is denser than warm air, and therefore, photons travel quicker through the less-dense hotter air. These photons take the path of least resistance when traveling, as the photons prefer to move through warmer air from point A to point B. Taking the warmer air path means the light bends in a parabolic path following this faster, warmer air; similar to driving a vehicle on an interstate in a curved route may be much faster than taking a direct route on a city street, even if the distance covered on the interstate is longer.

An optical illusion can thus occur as the human eye and brain, in conjunction, will automatically assume that light travels in a straight line. For a long-range shooter, mirage may occur causing the target to appear at either a more or less vertical location, a double target to optically appear, the target may appear to oscillate, or the target could disappear entirely behind what appears to be a wall of water but is actually the light waves refracting a reflection of the sky.

One specific type of mirage that is a great hindrance to long-range shooters occurs when the rifle has been fired enough to where the rifle barrel begins heating up and emitting heat waves. This creates barrel mirage. The long-range shooter typically uses a telescopic sight, otherwise known as an optic, which is generally located in a position such that the firearm barrel is located between the optic and the target. Due to the positioning of the optic and barrel, the heat emitting from the barrel causes the photons on the line between the optic and the target to refract which causes the target to optically appear in a different position than the position in which the target is actually located.

Current methods used to combat barrel mirage are the choice of either waiting for the barrel mirage to dissipate, or the method of trying to guess where the target is actually located by triangulating the target location from other known points.

However, these methods do not stop the mirage itself from appearing and the delays from either waiting or having to compute additional calculations can produce serious consequences in some environments. What is needed, therefore, is a device which is able to efficiently dissipate or transpose the heat emitted from a rifle barrel such that barrel mirage is reduced or eliminated.

BRIEF SUMMARY OF THE INVENTION

The present invention is directed to a heat displacement tool that extends at least half of the length of a firearm barrel. The length of the firearm barrel, as used herein, is the distance from the firearm receiver to the firearm muzzle. Wherein the receiver is the part of the firearm where the firearm bolt or firing mechanism is located, and wherein the muzzle is the distal end of the barrel closest to the target, and is also the end of the barrel in which the projectile exits. The heat displacement tool of the present invention also is affixed at a location between a firearm barrel and an optic or firearm rear sight, and the width of the heat displacement tool is extended to at least the width of the optic or alternatively a width which is wider than the width of the optic.

The present invention is directed to overcome the above-mentioned issues by providing an effective, durable, and semi-permanent system and method for allowing a firearm user ("user") to greatly reduce or eliminate barrel mirage. A preferred method of the heat displacement tool is not only well suited for shielding excess heat emitted from a firearm barrel, but which also directs the heat away from the vision of the firearm user.

In a particularly advantageous variant of the heat displacement tool, the heat displacement tool is affixed using a handguard clip, clipped around the entirety of the barrel in a similar fashion as a firearm handguard or barrel shroud, or attached via a Picatinny rail (MIL-STD-1913) or a Weaver rail. In this way, the heat displacement tool is able to maintain its structural integrity while a user is moving locations, reducing the probability that the heat displacement tool will negligently detach from its intended position. Other methods contemplated of affixing include forming the heat displacement tool with the barrel itself, attaching via hook and loop fastener, pressure insertion, and attaching to the optic, among others. It is expressly believed that other modifications, variations, and changes will be obvious to those with skill in the art and are within the scope of the claims hereto.

A Picatinny rail system is known as MIL-STD-1913, and is used herein to describe a standardized bracket used on firearms. The Picatinny rail is a general military standard rail system in which most firearm accessories are fitted today.

The heat displacement tool of the present invention is able to reroute the path of the emitted barrel heat by directing it outside the line of sight of the user, where the line of sight is defined herein as the vision area between the user and/or optic and the intended target. One embodiment of the present invention utilizes a curved structure similar to a crescent or lune. This unique shape, whether utilized concave or convex as to the barrel and/or optic (both of which are contemplated herein), reroutes the path of least-resistance for the emitted heat to outside the line of sight of the user.

In one embodiment contemplated, the sidewalls of the heat displacement tool are curved concave so as to additionally reroute the emitted heat, but the sidewalls may alternatively be straight, convex, divergent, convergent, or any other shape within the scope of this invention.

One preferred embodiment contemplated herein utilizes a plurality of vents along the exterior of the heat displacement tool which serves to reroute the emitted heat away from the line of sight of the user so as to reduce barrel mirage.

Another preferred embodiment utilizes at least one generally cylindrically-shaped, but possibly a plurality of generally cylindrically-shaped, tubes to act as an exhaust pipe so as to carry the emitted heat away from the line of sight. However, it may additionally be constructed in a prism shape, such as a rectangular prism or any other polygonal prism as well in order to achieve the desired function. The generally cylindrically-shaped tube may thus be any other type of shape without detracting from the spirit of the embodiment. The now-defined exhaust pipe may be located within the heat displacement tool and distally located beyond or above the line of sight of the user. Additionally, it is contemplated that the exhaust pipe or pipes may be external pieces which are attached or coupled to the inner walls of the heat displacement tool, or they may alternatively be formed channels or pipes within the walls themselves.

Further, it is contemplated that a preferred embodiment of the heat displacement tool will be constructed of a non-conductive material, so as to not to increase the heat emission of the barrel.

An embodiment of the present invention has a generally hollow core, otherwise known as an opening, formed in the heat displacement tool, so as to create a holding space for heat. This holding space serves to dissipate some of the heat through general air diffusion, which serves to reduce the temperature in which to create barrel mirage.

A further contemplated embodiment additionally utilizes heat reflective material to resist, block, and/or reflect emitted heat energy to prevent transfer through the heat displacement tool into the line of sight of the user. This heat reflective material may be on the inside or the outside of the heat displacement tool, and may further be used so as to route the emitted heat into an exhaust pipe, if any.

In some embodiments contemplated the vertical end closest to the barrel is an opening formed in the heat displacement tool, allowing the heat to readily enter a holding space hollow core.

Various other features, advantages, and objects of the present invention will be made apparent from the following detailed description and any appended drawings herein.

BRIEF DESCRIPTION OF THE FIGURES

One or more preferred exemplary embodiments of the invention are illustrated in the accompanying drawings in which like reference numerals represent like parts throughout and in which.

Before explaining one or more embodiments of the invention in detail, it is to be understood that the invention is not limited in its application to the details of construction and the arrangement of the components as set forth in the following description or as illustrated in any appended drawings. The invention is capable of other embodiments and appearances, and may be practiced or carried out in various ways. Also, it is to be understood that the phraseology and terminology employed herein is for the purpose of description and should not be regarded as limiting.

DETAILED DESCRIPTION OF THE INVENTION

Figure 1:
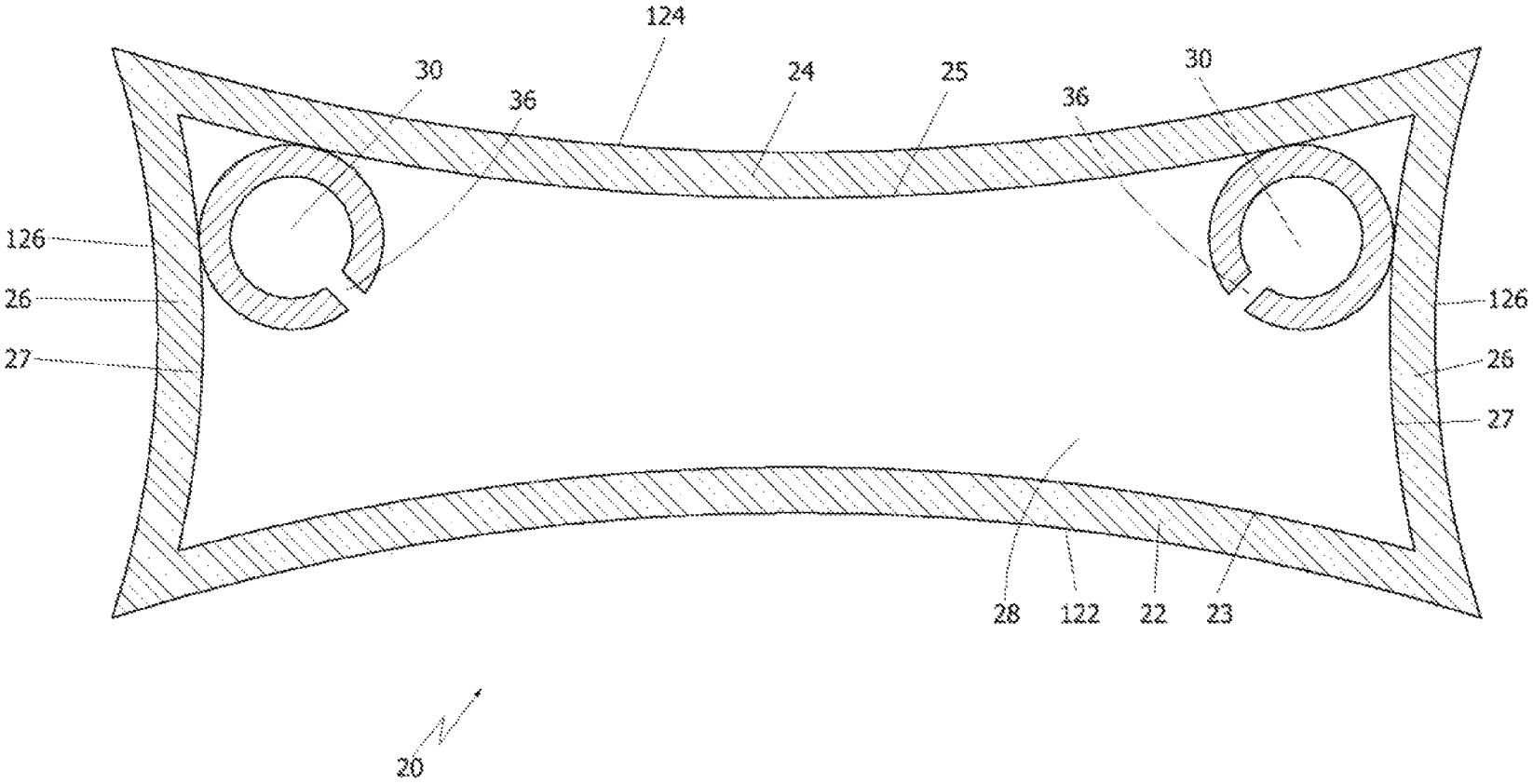
FIG. 1 is a section view of the heat displacement tool in accordance with some embodiments of the present invention.
Figure 2:
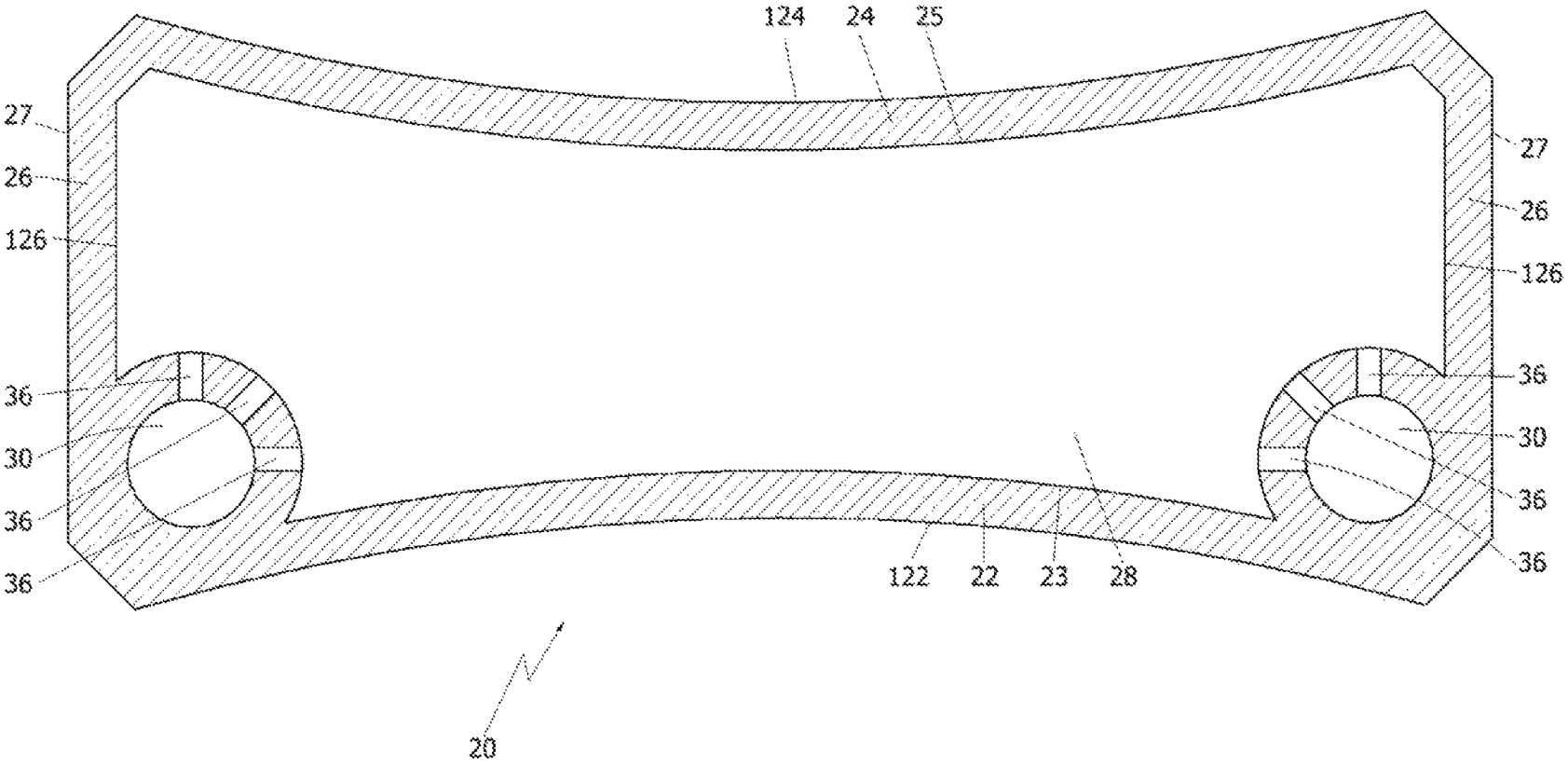
FIG. 2 is a section view of the heat displacement tool in accordance with some embodiments of the present invention.

FIGS. 1-2 illustrate a preferred embodiment of a heat displacement tool 20 constructed in accordance with the present invention that is preferably a removably attachable device, though it may be formed, having a bottom wall 22, a top wall 24, and a plurality of side walls 26.

Figure 3:
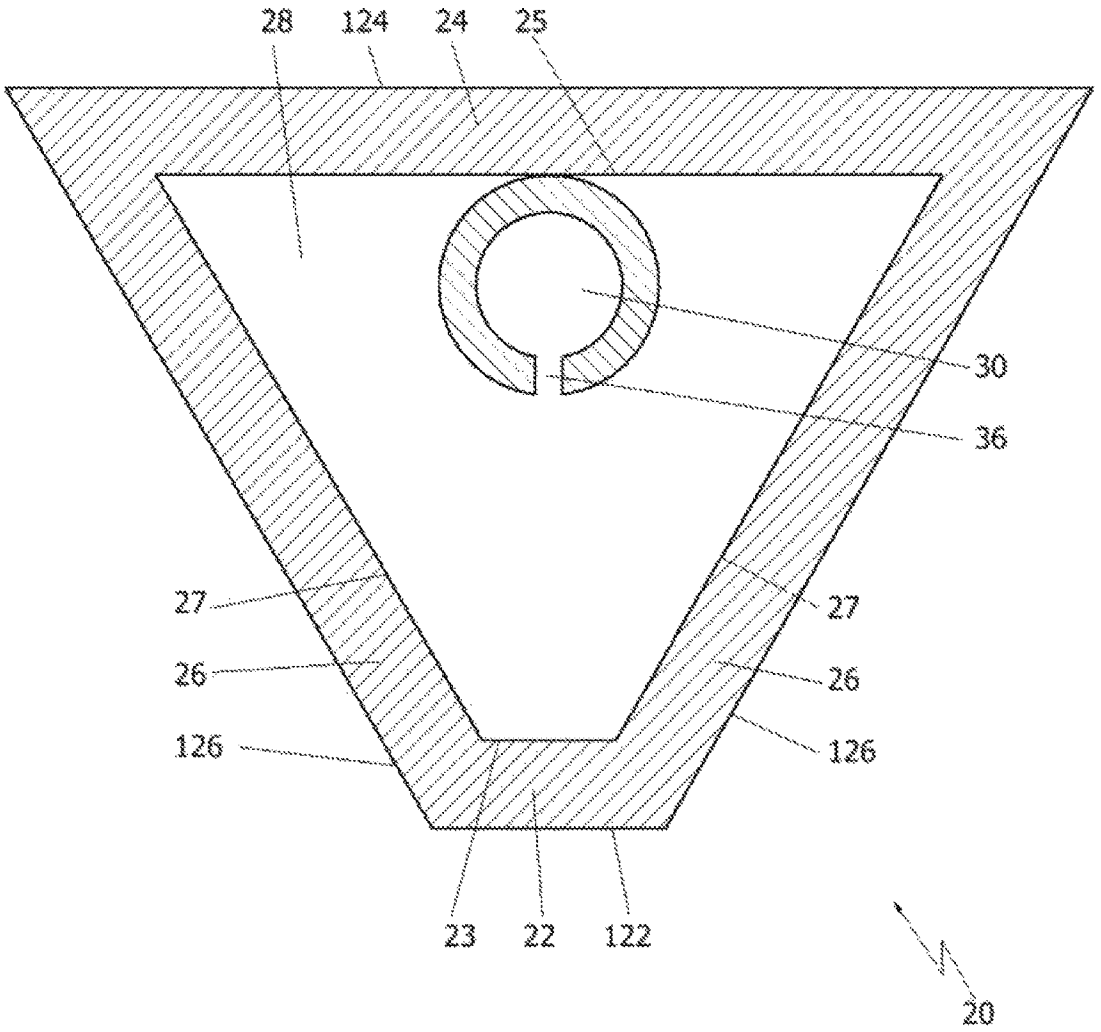
FIG. 3 is a section view of the heat displacement tool in accordance with some embodiments of the present invention.
Figure 7:
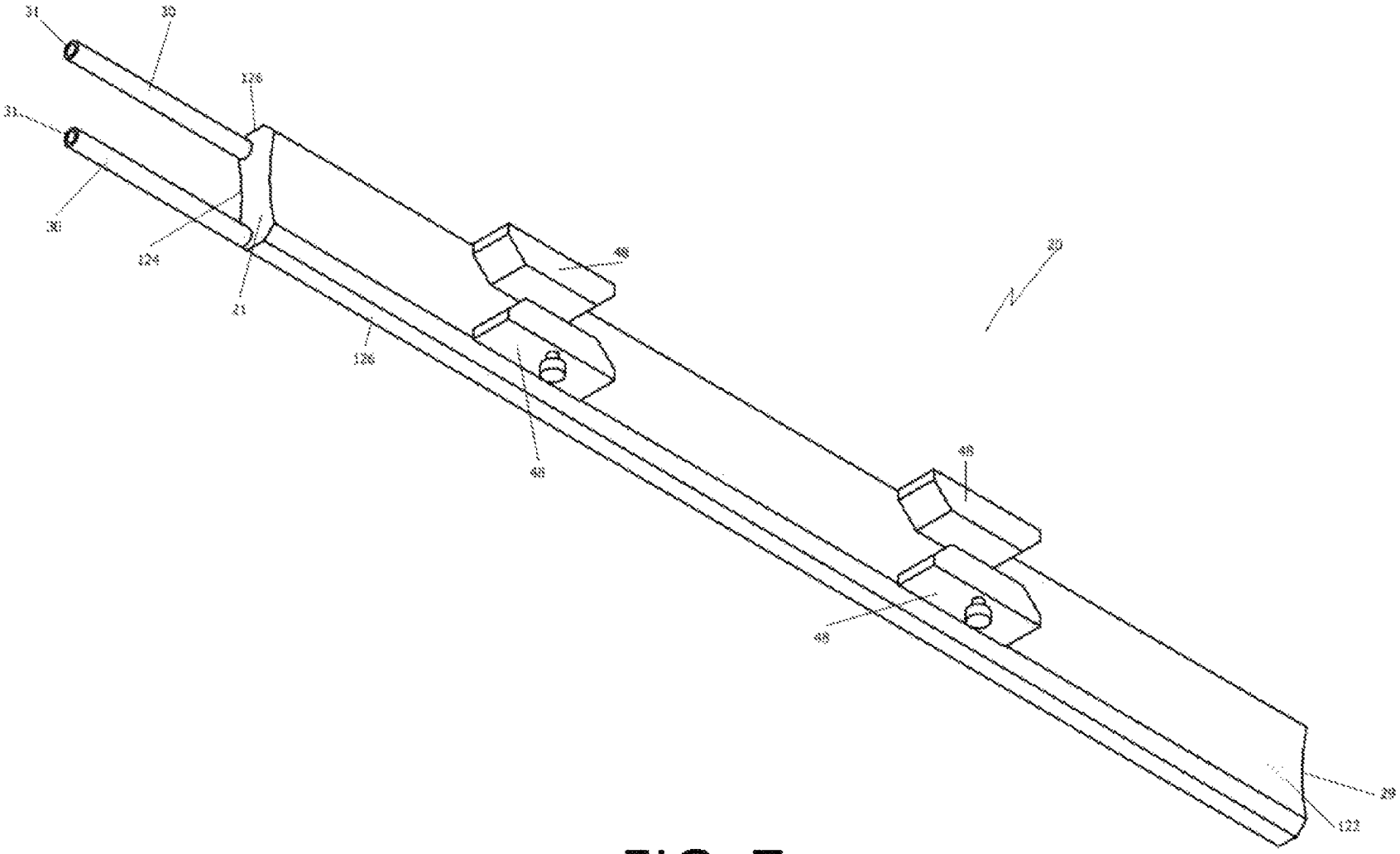
FIG. 7 is an upper perspective view of an embodiment of the present invention with two exhaust pipes.

The bottom wall 22 and outer bottom wall 122 may be designed in any shape, such as a generally curved shape so as to receive a firearm barrel 40 as shown in FIG. 1-2, a straight wall to rest on the top of a firearm barrel 40 such as is shown in FIG. 3, or any other shape conceivable. In some embodiments, the outer bottom wall 122 additionally contains at least one mounting interface for coupling to a Picatinny rail known as a Picatinny rail clamp 48, as is shown in FIG. 7. The bottom wall 22 may further be comprised of a series of vents or slots (not shown) otherwise known as a recess, such that the heat from a firearm barrel 40 is able to readily enter the core 28. While not required, it is further contemplated herein that the bottom wall 22 may be constructed of a different material, such as aluminum, copper, brass, steel, iron, diamond, or graphite, than the side walls 26 and top wall 24 are constructed of, which may encourage the firearm barrel heat to enter the core 28.

Figure 4:
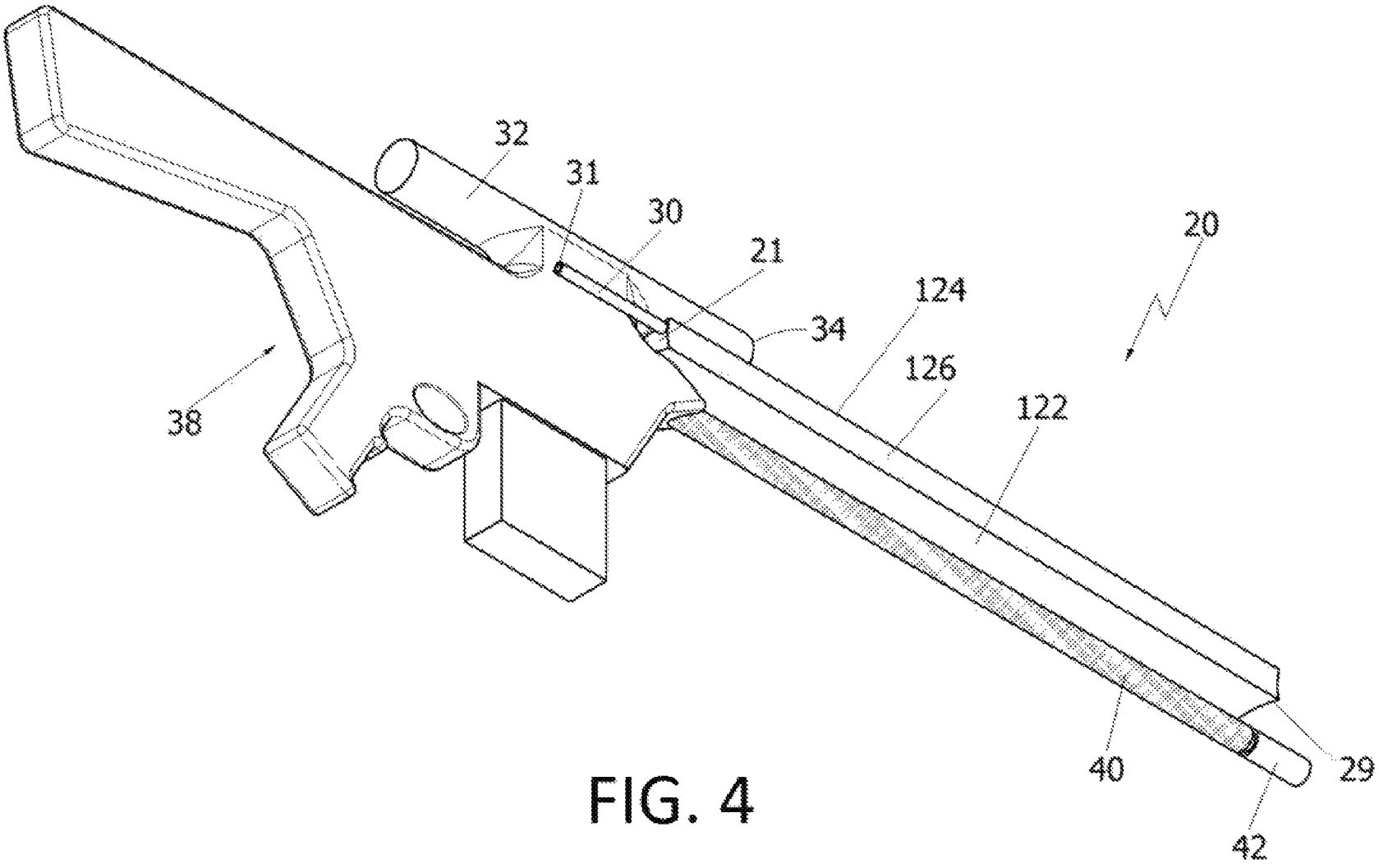
FIG. 4 is a bottom perspective view of an embodiment of the present invention coupled with a generic firearm.

The top wall 24 and outer top wall 124 of the heat displacement tool 20 may be designed in any shape, such as a generally curved shape, so as to best fit underneath an optic 32 as is shown generally in FIG. 4. Further, in some embodiments, the outer top wall 124 additionally contains at least one mounting interface for coupling to a Picatinny rail 44 such as with a Picatinny rail clamp 48, and allows for the heat displacement tool 20 to be utilized in an inverted position if so desired.

The plurality of side walls 26 and outer side walls 126 are the connecting walls for the top wall 24 and bottom wall 22. It is contemplated that the plurality of side walls 26 are generally curved such as in FIGS. 1-2, 4, and 6-7, so as to reduce the surface area and thus the weight of the heat displacement tool 20, but it need not be, and may additionally be linear such as in FIG. 3 or another shape without departing from the spirit of the invention. In some embodiments, the outer side walls 126 additionally contain Picatinny rails 44 such as the one shown in FIG. 5 which provides the user with the option of mounting additional firearm accessories on the heat displacement tool 20 itself.

Further, it is understood that the general shape of the heat displacement tool 20 may create additional side walls 26 and outer side walls 126, such as if the heat displacement tool 20 was a pentagonal prism, a hexagonal prism, an octagonal prism, or any other polygonal prism.

Also, the general shape of the heat displacement tool 20 is contemplated to be cylindrical or an approximate egg shape, creating a general tubular shape. In such a design, the existential presence may be diminished of the outer top wall 124, the outer bottom wall 122, and the outer side walls 126 so as there is a merger of these parts. However, this is an option which is contemplated and disclosed herein.

The heat displacement tool 20 may be shaped such that a central cavity housing core 28 is formed among the bottom wall 22, top wall 24, and side walls 26. More specifically, the central housing core 28 is contained within the inner bottom wall 23, the inner top wall 25, and the plurality of inner side walls 27, as depicted in FIGS. 1-3 and generally in FIG. 5.

Preferably at least the outer bottom wall 122, the outer top wall 124, and the outer side walls 126 are made of a durable material, so as to withstand wear and tear, as well as any damage that may be caused from transporting a firearm 38 through rugged terrain.

The heat displacement tool 20 can be designed custom for a variety of different firearms 38. This in particular allows the heat displacement tool 20 to tightly fit in an area between the firearm barrel 40 and the optic 32 which reduces the overall weight and additionally reduces the bulkiness of the heat displacement tool 20. Further, the core 28 can correspond in shape and size based on the custom design of the heat displacement tool 20, As such, the heat displacement tool 20 is preferably designed to be durable and lightweight. In some embodiments, the heat displacement tool is constructed from a wide variety of available materials, some of which are listed as examples, such as aluminum, thermoplastic acrylic-polyvinyl chloride, high-strength nylon-based polymers, stainless steel, or any alloy such as one of copper, tin, and zinc. The material selected may vary, but preferably the heat displacement tool 20 is sturdy, durable, and weather-resistant.

Figure 5:
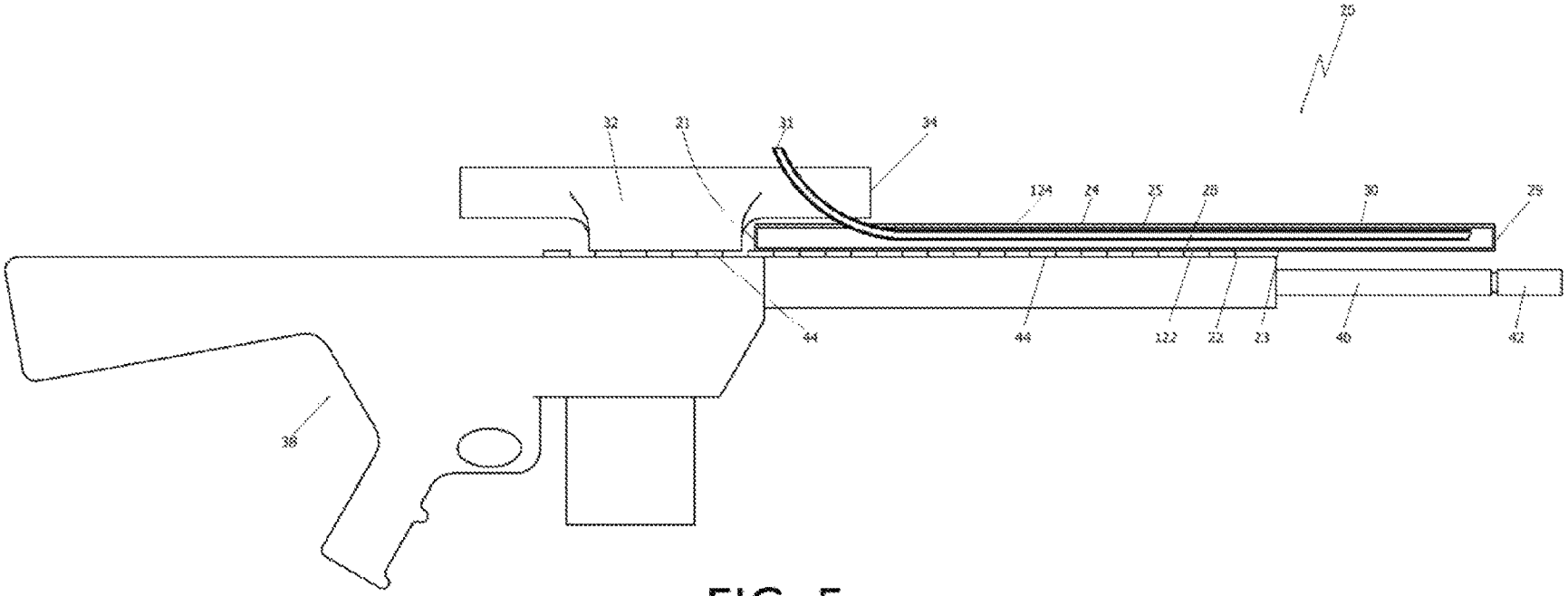
FIG. 5 is a side perspective view of an embodiment of the present invention illustrated as removably attached on a generic firearm.
Figure 6:
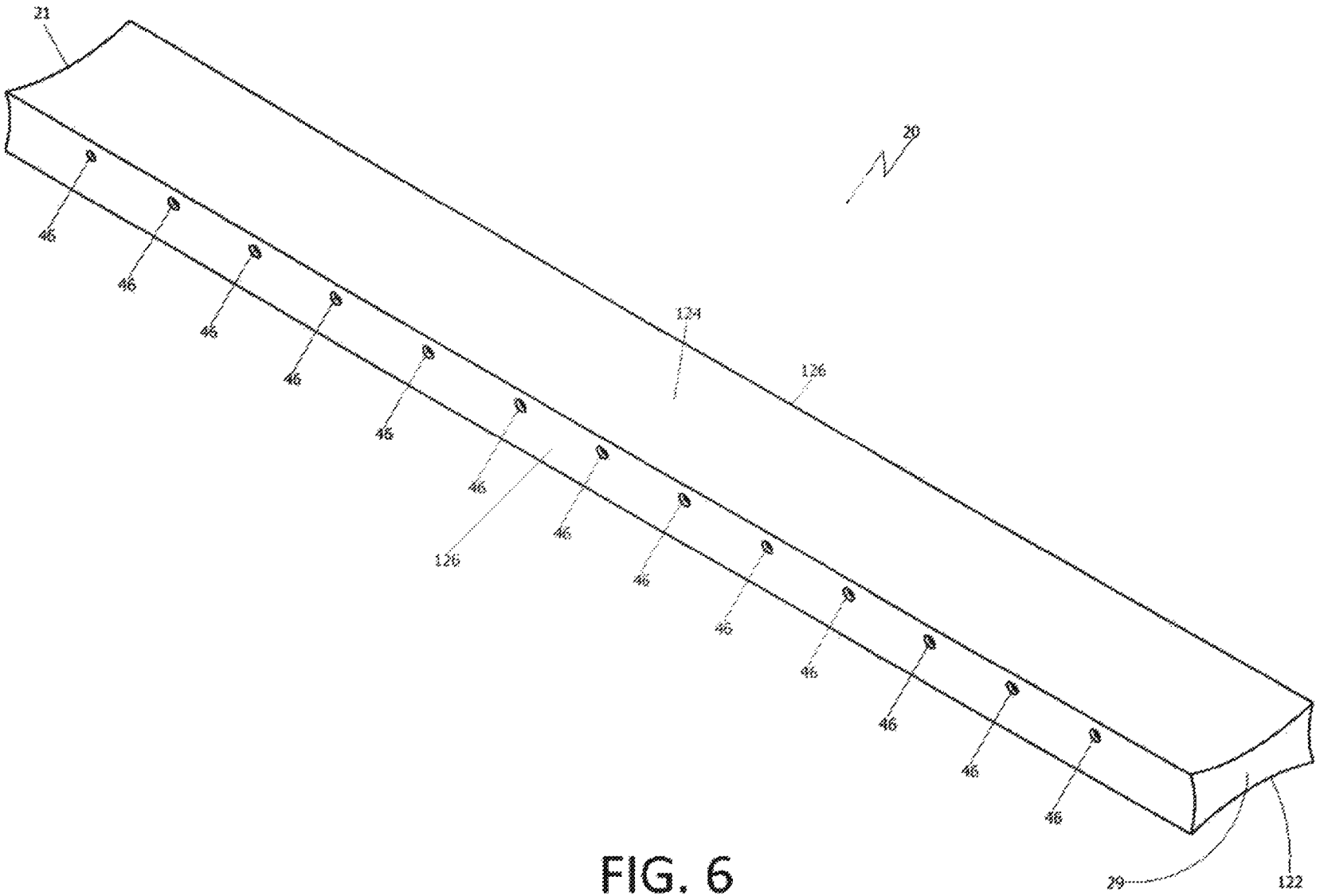
FIG. 6 is an upper perspective view of an embodiment of the present invention with multiple access vents.

It is contemplated that in one embodiment the heat displacement tool 20 may be enclosed, in which case the core 28 is formed among a bottom wall 22, a top wall 24, a front wall 29 like that depicted in FIGS. 6-7, a back wall 21 like that depicted in FIG. 4, and a plurality of side walls 26. The central housing core 28 is generally hollow. Heat may enter the core 28 by transferring through the bottom wall 22 from a firearm barrel 40 like that depicted in FIGS. 4-5, by way of general heat transfer.

It is preferably considered that the core 28 extends to at least half the length between the front wall 29 and the back wall 21. When the core 28 is at such a length, this provides a greater volume for the heat gases to be contained and/or dissipated. The core 28 is thus designed such that the heat enters this cavity and the heat begins to dissipate as it expands into the core 28 by way of heat thermal diffusion. The term thermal diffusion is known herein as the process of capturing the heat in a volume of the hollow core 28, wherein the barrel heat that enters the core 28 is mixed with the cooler air present in the core 28, and the temperatures of both dissipate, and reach a thermal equilibrium. This process of reaching thermal equilibrium as used and defined herein is similar to the equilibrium reached from when high temperature air, such as that in an oven, and mixes with the lower temperature air within the volume of a room once the oven door is opened. The mixed air raises the temperature of the room while simultaneously lowering the temperature of the air in the oven.

The inner bottom wall 23, inner top wall 25, and inner side walls 27, all of which form the boundaries of the core 28, may further be lined with heat reflective material (not shown), so as to prevent heat from escaping through the top wall 24 into the vision area of a firearm user. In another embodiment, a heat sink (not shown) may be added inside the core 28, in which the heat sink(s) would thus serve to absorb some of the firearm barrel heat. A heat sink, as contemplated herein, is a device used to disperse heat, such as for example an aluminum alloy, a copper alloy, or a diamond. These heat sinks may additionally be a pin-fin heat sink, a folded-fin heat sink, a skived heat sink, thermally conductive tape, or any other active or passive heat sink and it is contemplated they may additionally contain a power supply and fan for advanced heat sink effectiveness.

The heat displacement tool 20 may further contain an exhaust pipe 30, such as those seen in FIGS. 1-5, and 7. The exhaust pipe 30 or exhaust pipes 30, when used, are configured to be air guiding tubes or prisms, defined herein as tubular sleeves, despite the fact that the exhaust pipe 30 itself may not be cylindrical, and which carry the heat gases away from the core 28 and outside the vision area of a firearm user, such that barrel mirage is greatly reduced or eliminated from a user through an optic 32 or rear sight.

Heat gases enter the exhaust pipe 30 through at least one exhaust pipe vent 36. The exhaust pipe vent 36 may be any size or shape opening recess that allows the air or gas to enter into a confined space. When there are multiple exhaust pipe vents 36, such as shown in FIG. 2, there are multiple areas for the firearm barrel heat gasses to enter the exhaust pipe 30.

The exhaust pipe 30 is preferably heat-resistant, and is principally contained within the heat displacement tool 20, such that a user will not be exposed to a potential burn risk from the exhaust pipe 30. The exhaust pipe 30 in one embodiment extends outside the core 28 to an area outside either the back wall 21 as shown in FIGS. 4 and 7, or to an area outside the top wall 24 as depicted in FIG. 5. In such a matter, any heat which enters the core 28 may thus further enter the exhaust pipe 30, and be transposed to an area outside the vision area of a user. The vision area, as previously defined, is generally thought of as the area between the distal end of the optic 34 and the target, along a longitudinal viewing axis parallel to the axis of the firearm barrel 40.

The exhaust pipe 30 may be located at any location within the core 28. In FIG. 1, for instance, there are two exhaust pipes 30 which are located at a position near the inner top wall 25. The heat gasses will enter the core 28, and further enter the exhaust pipe 30 by entry through the exhaust pipe vents 36 located on or near the exhaust pipes 30. In FIG. 2, the exhaust pipes 30 are depicted as being located at a position near the inner bottom wall 23. The heat gases in this instance enter the core 28 and may enter an exhaust pipe 30 directly through an exhaust pipe vent 36, or may rest in the core 28 and further dissipate.

In FIG. 3, an alternative embodiment is shown with a single exhaust pipe 30. In such an embodiment, it is thought that a preferred location for the exhaust pipe 30 is centrally-located along the inner top wall 25, so as to collect a majority of the heat gases.

As is shown in FIG. 4, the heat displacement tool 20 is located at a position between the firearm barrel 40, and the firearm optic 32. The heat displacement tool 20 as shown is extended from the back wall 21 to the front wall 29 as depicted in FIG. 6-7, along a length of at least half of the firearm barrel 40, to a position near the muzzle 42 of the firearm 38. The exhaust pipe 30 is depicted extruding beyond the back wall 21, and the exhaust pipe mouth 31, which is the opening at the distal end of the exhaust pipe 30 furthest from the muzzle 42, is set so as to release captured heat gases outside the vision area of a user.

Turning to FIG. 5, an embodiment is shown where the optic 32 is attached to a generic firearm 38, and the heat displacement tool 20 is located between the firearm barrel 40 and the optic 32. The heat displacement tool 20 is further depicted consisting of at least half of the length of the firearm barrel 40. Additionally, the exhaust pipes 30 extend outwardly to an area away from the muzzle 42, and the exhaust pipe mouth 31 in this embodiment extends beyond the outer top wall 124 of the heat displacement tool 20 such that any heat released therefrom is outside the previously-defined vision area. Further, the heat displacement tool 20 is shown removably attached to a Picatinny rail 44. In order to facilitate adherence with the Picatinny rail 44, the bottom wall 44 may additionally contain a Picatinny clamp as shown in FIG. 7. A Picatinny clamp is a generic term used herein to describe a device for clamping, adhering, or otherwise attaching to a Picatinny rail 44. Those of skill in the art will know that there are multiple ways to successfully attach items to a Picatinny rail 44, all of which are contemplated herein.

When the heat displacement tool 20 is mounted via a Picatinny rail 44, the heat displacement tool 20 is operable to be located at a variety of positions along a firearm barrel 40 length, so as to provide portability.

As previously mentioned, the exhaust pipes 30 are optional parts of the heat displacement tool 20. In some embodiments, such as one as illustrated in FIG. 6, there are no exhaust pipes 30. Instead, the heat gases enter the core 28 of the heat displacement tool 20, and may exit the core 28 through an access vent 46, or a plurality thereof. It is contemplated that the ideal location for the access vent 46 will be at a location on or near the plurality of side walls 26. In this location, any escaping heat gasses will be expelled outside the vision area of the user. However, the location for the access vent 46 or access vents 46 may be at other locations along the exterior of the heat displacement tool 20 and still embody the present invention. An additional advantage to this particular embodiment is that cooler air from outside the heat displacement tool 20 is permitted to enter the core 28 through the access vent 46 or access vents 46. This cooler air works to help dissipate heat gasses contained within the volume of the core 28 by general heat diffusion.

Turning to FIG. 7, a preferred embodiment of the heat displacement tool 20 is shown inverted with rail clamps 48 on the outer bottom wall 122. These rail clamps 48 provide the ability to be mounted on a rail, such as a Picatinny rail as is shown in FIG. 5 or on a Weaver rail (not shown). This further allows the removable attachability on a rail, and the heat displacement tool 20 may be alternatively affixed in any other location where there is a mounting rail or rail extension.

Figure 8:
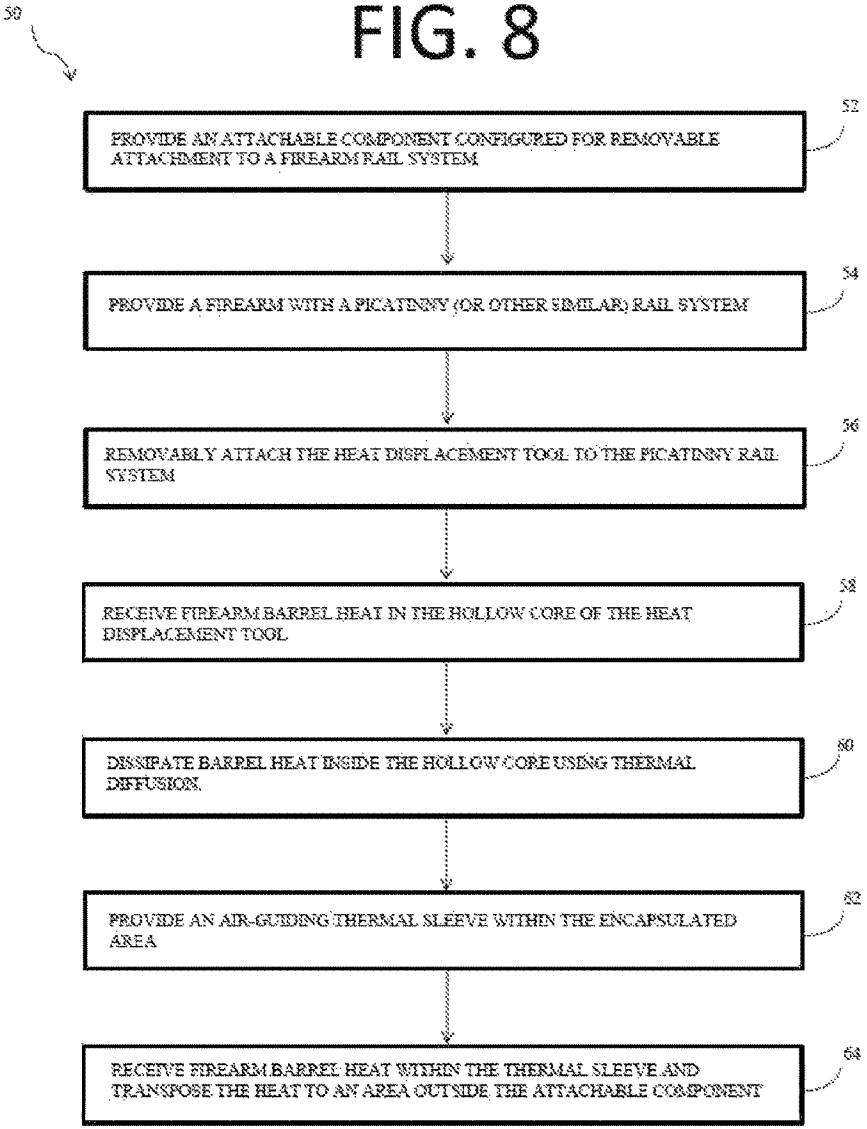
FIG. 8 illustrates a method to displace firearm barrel heat in accordance with some embodiments of the present invention.

FIG. 8 illustrates a method 50 for capturing and reducing firearm barrel heat in accordance with some embodiments of the present invention. Those with skill in the art will understand that this method 50 can be performed in various orders and arrangements, rearranging the steps as illustrated herein, and adding some additional actions, and further knowing that some steps are not necessary in particular circumstances.

This method 50 generally commences upon the action step of providing a removably attachable heat displacement tool component 52. In currently preferred embodiments, the component 52 has an encapsulated hollow area formed between a upper, a lower, and at least two lateral walls similar to those as described above. It may also additionally enclose this hollow area with a forward-facing wall and a rear-facing wall. Preferably, the lower wall is uniquely adapted so as to clamp to a firearm rail system.

The method 50 can also include the provision of a firearm with a rail system attachable surface 54, such as a Picatinny rail system, a Weaver rail system, or any other rail system similar to those described above. The method 50 may further include removably attaching, coupling, or adhering the component to the rail system 56.

The method 50 may further include the receiving firearm barrel heat within the enclosed hollow core of the previously-provided removably attachable component 58. This firearm barrel heat as it enters the volume of the enclosed space will start the process of heat dissipation through the process of thermal diffusion 60.

In some embodiments of the method 50, an air-guided thermal sleeve is provided 62 within the encapsulated area of the heat displacement component previously-provided. The air-guided thermal sleeve may further have one end jutting, or otherwise extending, outside of the encapsulated area. This allows the firearm barrel heat within the encapsulated area to enter the air-guiding tubular sleeve and be transposed outside of the area of the previously-provided heat displacement component 64.

Understandably, the present invention has been described above in terms of one or more preferred embodiments and methods. It is recognized that various alternatives and modifications may be made to these embodiments and methods that are within the scope of the present invention. It is also to be understood that, although the foregoing description and drawings describe and illustrate in detail one or more preferred embodiments of the present invention, to those skilled in the art of firearms, firearm accessories, long-distance target shooting, or in any other art to which the present invention relates, the present disclosure will suggest many modifications and constructions, as well as widely differing embodiments, applications and methods without thereby departing from the spirit and scope of the invention.

What is claimed is:

1. A firearm attachment device adapted for use with a firearm having a firearm optic and a firearm barrel, the firearm attachment device comprising:

an elongated generally straight central housing comprising a top wall, bottom wall, and a plurality of side walls;

a generally hollow core formed inside of the central housing top wall, bottom wall, and plurality of side walls, and wherein the generally hollow core extends the length of central housing;

wherein the bottom wall of the device is adapted for releasable attachment of the device onto a firearm at a location between a firearm optic and a firearm barrel.

2. The device of claim 1, wherein the generally hollow core is lined with heat reflectant material.

3. The device of claim 1, wherein the generally hollow core additionally comprises at least one heat sink.

4. The device of claim 1, wherein the generally hollow core further comprises at least one tubular sleeve having a channel extending longitudinally therethrough and extending a majority of the length of the generally hollow core.

5. The device of claim 4, wherein the tubular sleeve extends to a length greater than that of the central housing.

6. The device of claim 4, wherein the tubular sleeve extends to an area outside that of the top wall of the device.

7. The device of claim 1, wherein the bottom wall is further adapted for releasable attachment on a Picatinny rail.

8. The device of claim 7, wherein the generally hollow core further comprises at least one tubular sleeve having a channel extending longitudinally therethrough and extending a majority of the length of the generally hollow core.

9. The device of claim 8, where the tubular sleeve extends to a length greater than that of the central housing.

10. The device of claim 1, wherein the bottom wall is further adapted for releasable attachment on a Weaver rail.

11. The device of claim 1, wherein at least one of the plurality of side walls additionally comprise a surface that defines at least one aperture.

12. The device of claim 11, wherein the bottom wall is further adapted for releasable attachment on a Picatinny rail.

13. The device of claim 11, wherein the bottom wall is further adapted for releasable attachment on a Weaver rail.

14. A method for capturing and reducing firearm barrel heat using a heat displacement tool mounting on a rail, comprising the steps of:

providing a heat displacement tool having a top wall, a bottom wall, and a plurality of side walls, the bottom wall being dimensioned to close closely fit to and slidably receive a Picatinny rail's transversely projecting features;

providing a generally hollow core formed in an area of the heat displacement tool top wall, bottom wall, and plurality of side walls;

affixing the heat displacement tool to an area between that of a firearm optic and a firearm barrel;

receiving firearm barrel heat in the hollow core area inside that of the heat displacement tool;

wherein the firearm barrel heat in the hollow core area inside that of the heat displacement tool is dissipated with heat diffusion.

15. The method of claim 14 wherein an air-guiding tubular sleeve is generally disposed within the area inside that of the heat displacement tool, and wherein a distal end of the air-guiding tubular sleeve extends outside that of a distal end of the heat displacement tool.

16. The method of claim 15 further comprising: receiving firearm barrel heat in the air-guiding tubular sleeve from the area inside that of the heat displacement tool, and transposing the firearm barrel heat from the air guiding tubular sleeve to an area outside that of the heat displacement tool.

17. The method of claim 14, further comprising the step of lining the generally hollow core with heat reflectant material.

18. The method of claim 14, further comprising the step of affixing at least one heat sink within the generally hollow core.

19. The method of claim 14, wherein at least one of the plurality of side walls additionally comprise a surface that defines at least one aperture.

* * * * *